US005137497A

United States Patent [19]

Dubeta

[11] Patent Number: 5,137,497

[45] Date of Patent: Aug. 11, 1992

[54] SLIDE APPARATUS

[76] Inventor: David J. Dubeta, P.O. Box 539, Sylvan Lake, Alberta, Canada, T0M 1Z0

[21] Appl. No.: 678,204

[22] Filed: Apr. 1, 1991

[51] Int. Cl.[5] ..... A63G 21/00

[52] U.S. Cl. ..... 472/88; 472/117

[58] Field of Search ..... 272/56.5 R, 56.5 SS; 104/70

[56] References Cited

U.S. PATENT DOCUMENTS

| | | | |
|---|---|---|---|
| 1,279,911 | 9/1918 | Ridgway | 272/35 |
| 1,577,689 | 3/1926 | Capitelli | 272/35 |
| 2,086,697 | 9/1957 | Huhn et al. | 272/35 |
| 4,836,521 | 6/1989 | Barber | 272/32 |
| 4,971,314 | 11/1990 | Barber | 272/35 |

*Primary Examiner*—Richard E. Chilcot, Jr.
*Attorney, Agent, or Firm*—Shlesinger, Arkwright & Garvey

[57] ABSTRACT

For the most part, there has been very little innovation in the design of water or other slides. An interesting development in this area involves a slide apparatus including a trough with an upper slide surface of generally parabolic, upwardly opening cross section throughout its length, the slide being tilted from the rear inlet end thereof to the front outlet or discharge end thereof. Riders on the slide move along a path of travel resembling that of an underdamped oscillator, and for the first time riders are able to experience the sensation of sliding forwardly and backwardly within a waterslide configuration, in complete safety, throughout the duration of the ride.

14 Claims, 4 Drawing Sheets

SLIDE APPARATUS

BACKGROUND OF THE INVENTION

1. Field of the Invention

This invention relates to a slide apparatus and in particular to a water slide apparatus.

While the invention described in the following is primarily intended as a so-called water slide, it will be appreciated that the slide could be used with or without water, the water being used merely to promote sliding and possibly as a braking medium.

2. Discussion of the Prior Art

Water slides have become a popular in only the relatively recent past. Such apparatus are usually elongated tubes or troughs following a circuitous path downwardly from an elevated starting platform. A typical apparatus of the above-mentioned type is described in U.S. Pat. No. 4,194,733, which issued to B. Whitehouse, Jr. on Mar. 25, 1980. There has been precious little change in the basic design of such water slides since they first became popular The loading areas of water slides often present a problem. The user of the slide is required to move directly from a flat, horizontal platform to a steep chute or trough. Alternatively, the user must step into or seat himself in a tippy conveyance already floating in water. Moreover, in order to ensure that people do not collide on the slide, the attendant or operator of the slide must wait until one rider is at or near the bottom of the slide before admitting another user to the top, inlet end thereof. This problem is exacerbated by the fact that because of the shape of many such slides, the user is not visible throughout much of the ride.

GENERAL DESCRIPTION OF THE INVENTION

An object of the present invention is to solve the problem of user safety by providing a relatively simple, open topped slide apparatus which can accommodate more than one rider at a time.

Another object of the invention is to provide a slide which is interesting in terms of both shape or configuration and the forward and backward path of travel of users on the apparatus.

A further object of the invention is to provide an open slide surface all areas of which are visible to the slide operator or attendant thus giving the operator a clear view of all riders on the slide.

Accordingly, the present invention relates to a slide apparatus comprising trough means; and a slide surface defining the top of said trough means, said slide surface having a generally parabolic, upwardly opening cross section, sloping downwardly from a rear, inlet end of said surface to the front, outlet end of said surface.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENT

Figure 1:
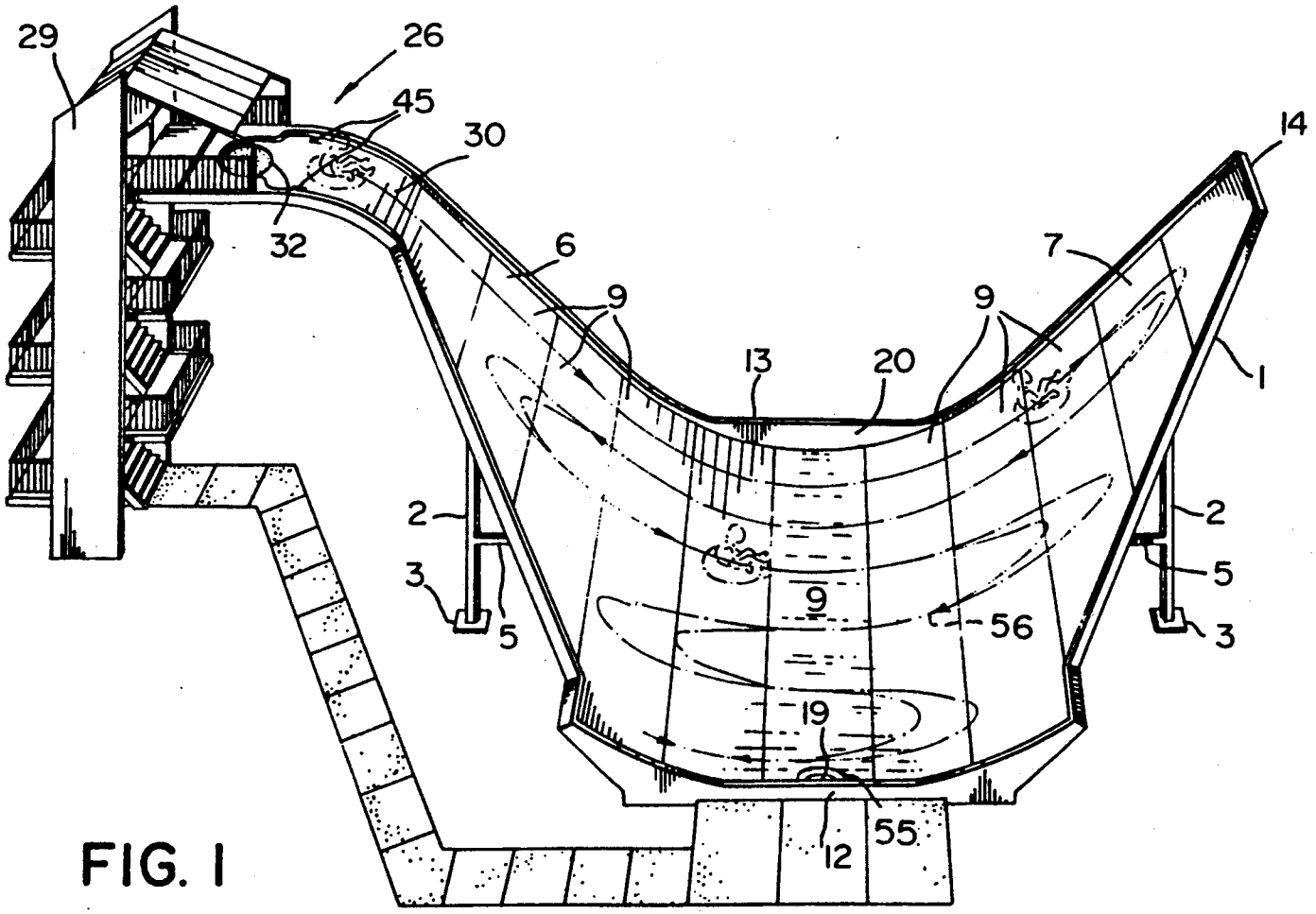
FIG. 1 is a schematic, isometric view of a slide apparatus in accordance with the present invention.

In the drawings, geometry and dimensions are not necessarily accurate. The drawings are schematic, and are primarily intended to facilitate an understanding of the invention, such that it could readily be reproduced.

Figure 2:
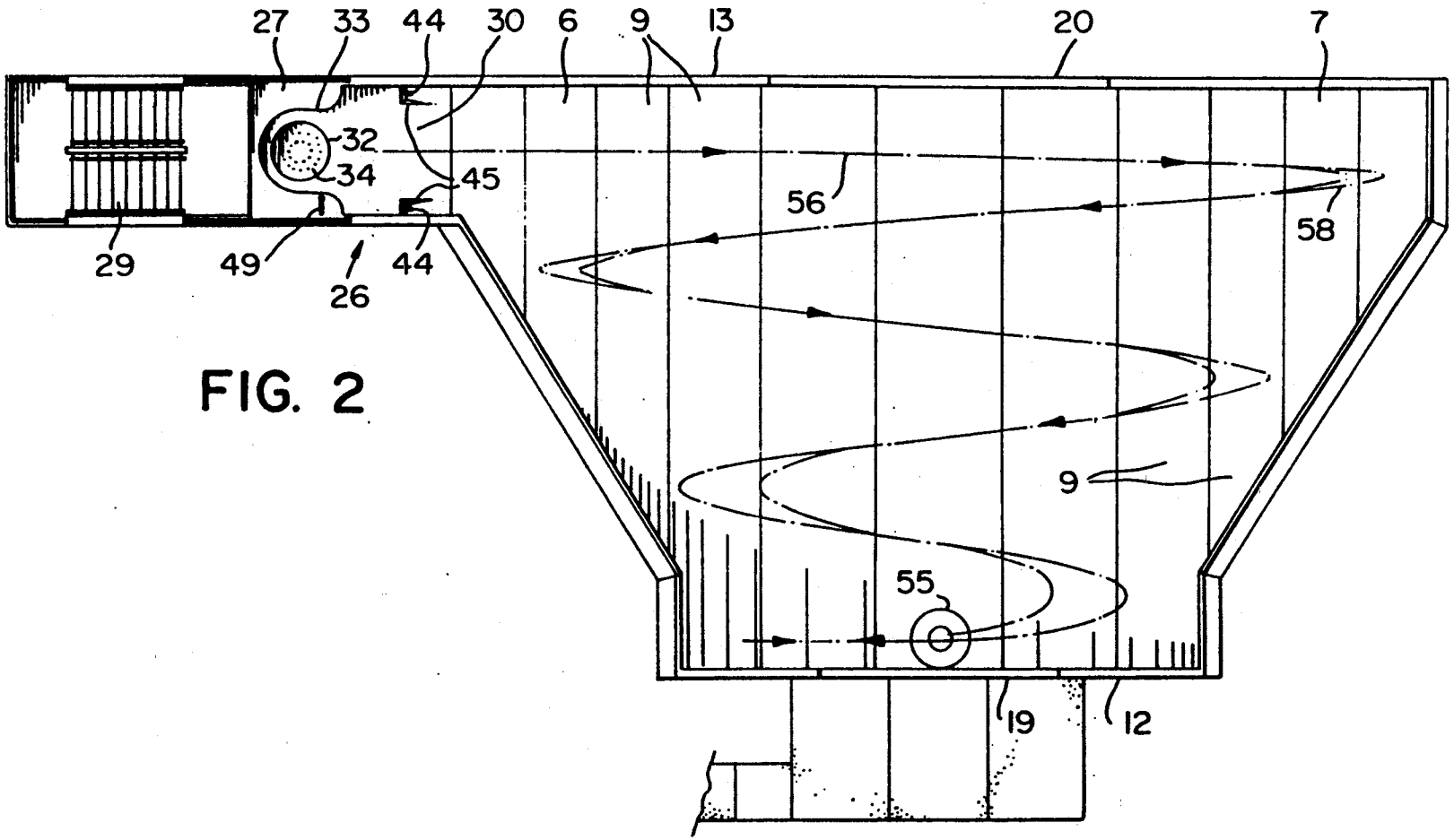
FIG. 2 is a schematic, plan view of the slide apparatus of FIG. 1.
Figure 3:
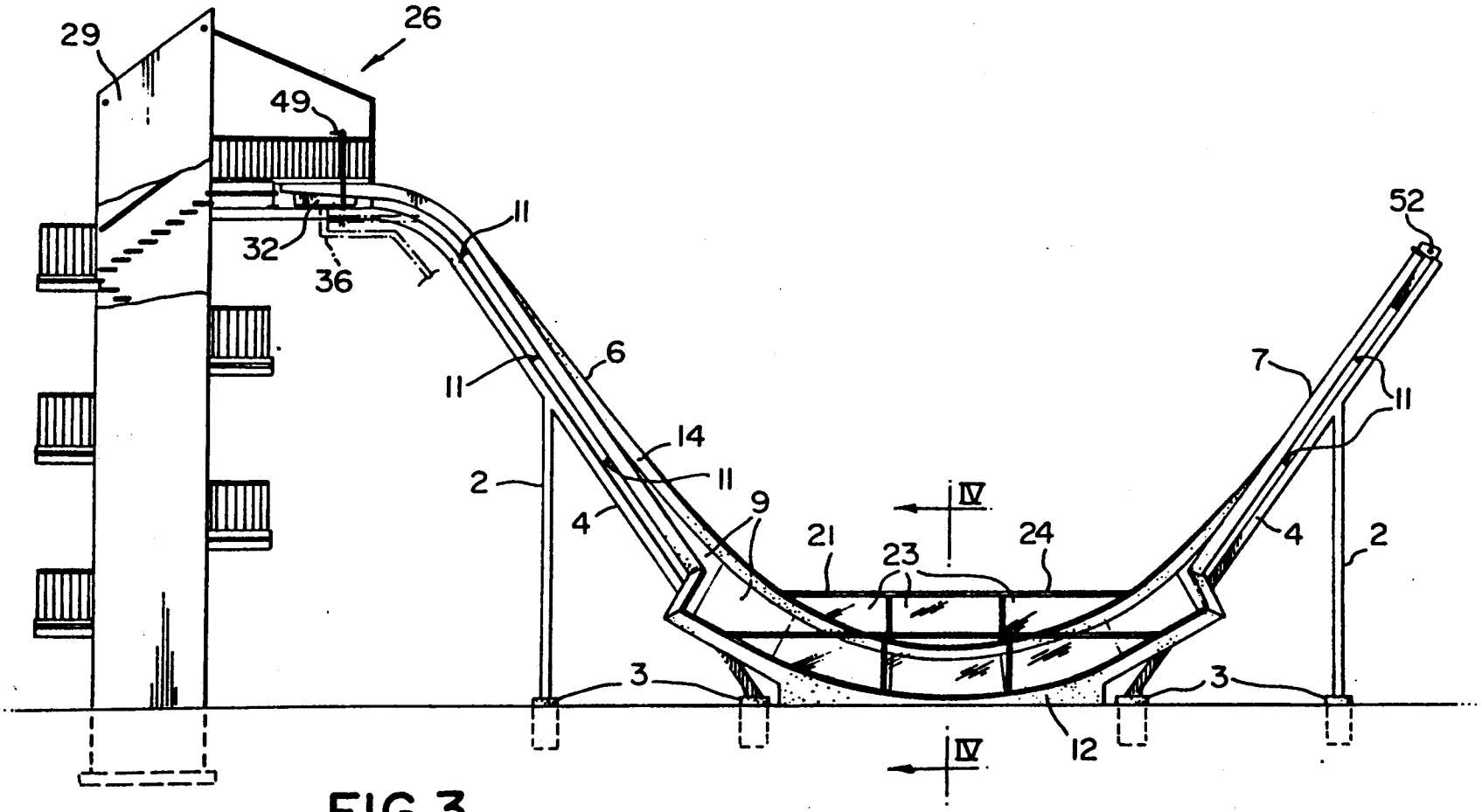
FIG. 3 is a schematic, partly sectioned front view of another embodiment of the slide apparatus of the present invention.

With reference to FIGS. 1 and 2, a slide apparatus in accordance with the present invention includes a base 1 supported by a frame in the form of posts 2 embedded in concrete footings 3. Inclined braces 4 (FIG. 3) are mounted on the upper ends of the posts 3. Crossbars 5 extend between the posts 3 and the braces 4. The braces 4 support the inclined sides 6 and 7 of the base 1. It will be appreciated that the number and spacing of the supports will depend upon the dimensions of the apparatus.

Figure 4:
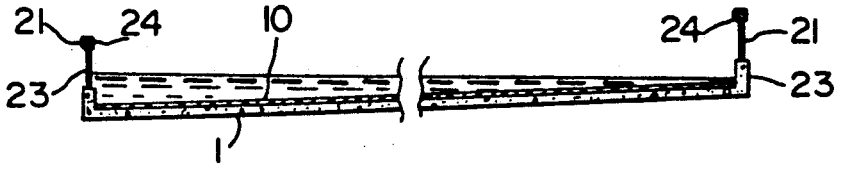
FIG. 4 is a cross section taken generally along line IV—IV of FIG. 3.

The slide portion of the apparatus (FIGS. 1–3) is defined by a plurality of panels 9 mounted on the base 1. Depending upon circumstances, the base 1 can be omitted, and substituted by premanufactured, prefinished panels, interconnected together and attached directly to the structured framework of the slide. As best shown in FIG. 4, a slide layer 10 can be attached directly to a concrete or other base 1. In either of the first two cases, the panels 9 include downwardly extending flanges 11 (FIG. 3) on each side thereof for interconnecting the panels in side by side relationship, so that the panels extend between the front and rear ends 12 and 13, respectively of a curb 14 extending around substantially the entire periphery of the slide.

The base 1 and the slide surface formed by the panels 9 form a generally parabolic, upwardly opening trough structure, which is inclined forwardly and downwardly from the rear end 13 to the front end 12 thereof. The areas 19 and 20 of the curb 14 at each end of the bottom of the trough are higher than the remainder of the border for defining barriers, which retain water in the apparatus. Alternatively, a fence 21 (FIGS. 3 and 4) formed of transparent panels 23 and a top rail 24 can be provided at the rear of the bottom of the trough.

The front end 12 of the trough extends forwardly from proximate the bottom ends of the sides 6 and 7, and defines a discharge or dismount area where users exit from the slide apparatus. The sides 6 and 7 of the slide slope upwardly and outwardly, tapering to a narrow upper end on one side 7 and to a loading area generally indicated at 26 on the other side 6. The loading area 26 includes a narrow, rectangular, gently sloping ramp or platform 27 (FIG. 2) connecting a set of stairs 29 to a convex, downwardly inclined transition area 30 at the top rear end of the side 6.

Figure 5:
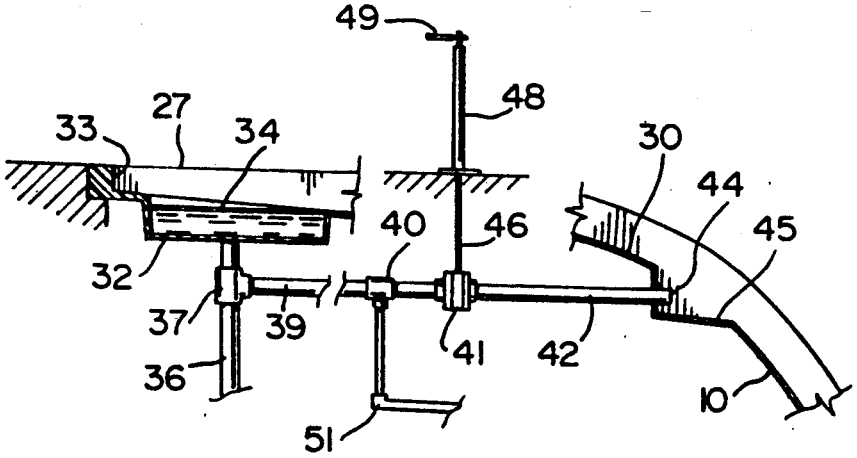
FIG. 5 is a schematic, partly exploded, sectional view of a top, inlet portion of the slide apparatuses of FIGS. 1 to 3.

A circular basin 32 is provided in a convex recess 33 in the ramp 27. A perforated, circular cover 34 (FIG. 2) controls the discharge of water from the basin onto the ramp 27. Water is introduced into the basin 32 via an inlet pipe 36 (FIG. 5). A tee joint 37 in the pipe 36 permits bypassing of the basin 32, so that water flows through a pipe 39 to a tee joint 40, a valve 41 and a pipe 42. A discharge end 44 of the pipe 42 extends into a rectangular recess 45 in the top of the transition area 30 of the slide. As shown in FIG. 2, similar discharge pipes 42 are provided on both sides of the transition area 30. The valve 41 is controlled by a rod 46 extending upwardly through a post 48 mounted on the platform 27.

A valve operating handle 49 is provided on the top end of the rod 46. Another pipe 51 (or pipes) connected to the joint 40 carries water to other parts of the slide. As shown schematically in FIG. 3, a manifold or pipe 52 can be provided on the upper end of the opposite side 7 for discharging water through ports (not shown) in the curb on such other side 7. Water can be fed onto the slide at any point along the length thereof, the water acting as a lubricant to facilitate sliding. Water discharged into the slide is collected via a weir (not shown) located within the raised curb 14 along the front end 12 of the trough and is recycled through a filtration system and pumped back up to the top of the slide.

Referring again to FIGS. 1 and 2, in use, a user carrier or conveyance, for example, an inner tube 55 is placed on or in the basin 32, i.e. on or above the cover 34. By operating the valve 41, the operator diverts water normally flowing through the pipes 42 to the basin 32. The water passes through the cover 34 to initiate movement of the inner tube 55. This arrangement ensures safety during loading. Normally riders are required to seat themselves in a conveyance which is floating in a pool of water. Since many conveyances are somewhat tippy, injuries can and do occur. The elimination of the permanent pool of water allows for safe loading on a flat, slightly sloping, relatively dry surface. The inner tube 55 flows along a path of travel 56 down the transition area 30 and the side 6 of the slide. Momentum carries the tube 55 and the rider past the upwardly and rearwardly extending longitudinal axis and up the opposite side 7. Depending on the weight of the rider, the inner tube 55 will rise up the side 7 to somewhere in the area 58 (FIG. 2), at which point direction of travel of the inner tube 55 reverses backwards and, because of the longitudinal inclination of the trough, the rider moves backwardly and downwardly towards the front end 12 of the apparatus. Thus, the path of travel of the inner tube 55 and the rider when viewed from above resembles that of an underdamped oscillator.

With the structure described above, once a first rider has completed as little as one oscillation, a second rider can start down the slide with little danger of a collision occuring. As the rider and inner tube oscillate in the trough, the amplitude of the oscillations becomes progressively smaller due to friction and the damping effect of water in the bottom of the trough. Because the trough is tilted forwardly towards the discharge end, the width and depth of the pool in the bottom of the trough gradually increase as the rider moves down the slide. The water serves as a braking device, which, in effect, becomes more powerful with each oscillation. The water enhances the ride experience, since each oscillation creates a progressively larger splash.

As will be appreciated, it is preferable that the level of water in the pool be maintained constant. This can be accomplished by any conventional water level control valve arranged as by the aforementioned weir which permits a continuous even flow thus controlling water level. Of course, the pool can be eliminated, permitting a larger number of oscillations before a rider comes to a full stop. In this situation, the length of the apparatus would be increased. It is also worth noting that virtually all splash water would be retained in the apparatus, because of the speed of descent decreasing to close to nil as the rider approaches the discharge end.

It will be appreciated that the apparatus described hereinbefore lends itself to a large variety of different construction methods. For example, the apparatus can be formed of prefabricated, fiberglass/plastic panels bolted together and supported by a skeletal steel frame, which is anchored in concrete footings. In fact, the entire apparatus could be prefabricated for shipping to a construction site.

Another possibility is the use of a concrete or wooden base constructed on site and having the design profile required. The slide surface can be fiberglass/plastic sprayed onto the base, and sanded, painted and polished to a finish comparable to a prefabricated panel finish. Alternatively, the slide surface can be sheets of plastic bonded to the base. In some locations, the terrain can be profiled or carved to the desired more or less parabolic shape, and so-called gunite concrete methods used to form the slide base. It will be also appreciated that the height of the slide can be variable, for example a small slide constructed for young children could have a height of for example 15 feet while for older riders the height could be as much as 50 feet.

Finally, the entire apparatus could be modular for quick assembly, disassembly for transport to various sites as a fair or carnival ride.

I claim:

1. A slide apparatus comprising:

(a) a fixed trough means having a bottom and a top;

(b) a slide surface disposed on said trough;

(c) said slide surface having a substantially parabolic, upwardly opening cross section, and said slide surface sloping downwardly from said top to said bottom;

(d) said slide surface having a longitudinal axis extending downwardly and forwardly from said top to said bottom;

(e) said trough having a first upper wall disposed on one side of said longitudinal axis and a second, opposed upper wall disposed on the other side of said longitudinal axis;

(f) a slide entrance disposed on at least one of said first and second upper walls at said top of said trough for causing a user or a conveyance carrying a user to enter said trough and contact said slide surface transversely to said longitudinal axis; and (g) whereby, a user or a conveyance carrying a user enters said slide entrance, travels on said slide surface from said first upper wall downwardly toward said longitudinal axis, crosses said longitudinal axis, then travels upwardly toward said opposed second upper wall, and then the user or the conveyance carrying a user travels backwardly downwardly past said longitudinal axis and upwardly toward said first upper wall, said surface thereby causing a back and forth motion of the user or a conveyance carrying a user to be repeated one or more times until the user exits at the bottom of said slide surface.

2. An apparatus according to claim 1, including:

(a) a gently sloping inlet ramp means disposed at said slide entrance; and (b) a convex transition area connecting said ramp means to said slide surface.

3. An apparatus according to claim 2, including:

(a) a basin means defined in said inlet ramp means; and (b) a water inlet means disposed in said basin means for introducing water into said basin means, the water serving as a motive force for a user or conveyance carrying a user of said apparatus.

4. A slide apparatus comprising:

(a) a trough means;
(b) a slide surface defining a top of said trough means;
(c) said slide surface having a substantially parabolic, upwardly opening cross section, and said slide surface sloping downwardly from a rear, inlet end of said slide surface to a front, outlet end of said slide surface; and
(d) wherein said trough means and slide surface are wider at said rear end, and taper forwardly to said front, outlet end.

5. An apparatus according to claim 4, including skeletal frame means supporting said trough means.

6. An apparatus according to claim 4, wherein said trough means includes a plurality of separable panel means extending from the rear end to the front end of the apparatus.

7. An apparatus according to claim 6, including curb means extending upwardly from said slide surface around substantially the entire periphery thereof.

8. An apparatus according to claim 6, including curb means extending upwardly from said slide surface around substantially the entire periphery thereof, the curb means having higher end sections at the bottom of said trough means for retaining water therein.

9. An apparatus according to claim 4, including skeletal frame means; and base means on said frame means supporting said trough means.

10. A slide apparatus comprising:
(a) a trough means;
(b) a slide surface defining a top of said trough means;
(c) said slide surface having a substantially parabolic, upwardly opening cross section, and said slide surface sloping downwardly from a rear, inlet end of said slide surface to a front, outlet end of said slide surface;
(d) a gently sloping inlet ramp means defining an upper, rear end of one side of said slide surface;
(e) a convex transition area connecting said ramp means to the remainder of said one side of said slide surface;
(f) a basin means defined in said inlet ramp means;
(g) a water inlet means disposed in said basin means for introducing water into said basin means, the water serving as a motive force for a user or conveyance carrying a user of the apparatus; and
(h) a bypass pipe means connected to said inlet means for feeding some of the water from said inlet means to areas of said slide surface.

11. An apparatus according to claim 10, including:
(a) a valve means in said bypass pipe means for controlling the flow of water from said inlet means; and
(b) an outlet pipe means in said convex transition area connected to said valve means for feeding water to said transition area.

12. An apparatus according to claim 10, wherein said trough means and slide surface are wider at said rear end, and taper forwardly to said front, outlet end.

13. An apparatus according to claim 10, including curb means extending upwardly from said slide surface around substantially the entire periphery thereof.

14. An apparatus according to claim 10, including:
(a) a curb means extending upwardly from said slide surface around substantially the entire periphery thereof; and
(b) said curb means having higher end sections at the bottom of said trough means for retaining water therein.

* * * * *